US006168287B1

(12) United States Patent
Liu

(10) Patent No.: US 6,168,287 B1
(45) Date of Patent: Jan. 2, 2001

(54) COMBINATION OF AN ELECTRIC-POWERED TOOL AND AN ILLUMINATING DEVICE RECEIVED IN THE TOOL

(76) Inventor: Kuo-Chen Liu, No. 20, Da Chen Street, Tai Li Hsiang, Taichung Hsien (TW)

( * ) Notice: Under 35 U.S.C. 154(b), the term of this patent shall be extended for 0 days.

(21) Appl. No.: 09/264,682

(22) Filed: Mar. 9, 1999

(51) Int. Cl.[7] ..... B25B 23/18

(52) U.S. Cl. ..... 362/119; 362/190; 362/253; 362/394

(58) Field of Search ..... 362/109, 119, 362/157, 253, 190, 89, 394

(56) References Cited

U.S. PATENT DOCUMENTS 5,401,928 * 3/1995 Kelly ..... 200/510
5,427,002 * 6/1995 Edman ..... 81/57
5,445,479 * 8/1995 Hillinger ..... 408/16
5,797,670 * 8/1998 Snoke et al. ..... 362/119
5,954,458 * 9/1999 Lee ..... 408/16
5,982,059 * 11/1999 Anderson ..... 310/50

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

An electric-powered tool includes a handle for receiving batteries herein and a barrel with a driving shaft rotatably connected to the distal end of the barrel portion. The driving shaft is controlled by a switch which is electrically connected between the batteries and the driving shaft. An illuminating device includes two bulbs attached beside the driving shaft and the bulbs are electrically connected to the switch so that when turning on the switch, the bulbs light to illuminate the object to be worked with.

1 Claim, 4 Drawing Sheets

COMBINATION OF AN ELECTRIC-POWERED TOOL AND AN ILLUMINATING DEVICE RECEIVED IN THE TOOL

FIELD OF THE INVENTION

The present invention relates to an electric-powered tool and an illuminating device received in the tool, and more particularly, to an electric-powered tool having two illuminating members connected beside the driving shaft and the illuminating members are controlled by a switch attached to the body of the tool.

BACKGROUND OF THE INVENTION

Many conventional electric-powered tools are designed to improve their functions or features to perform quickly or powerfully. One of the advantages of the electric-powered tool is that the electric-power makes the work to be easily completed so that any user can use the tool without troubles. However, although most of the electric-powered tools have a great feature to powerfully drill a hole or hammer a nail, they do not equipped with an illuminating device to provide sufficient light on the object. In other words, if the user wants to work in a dark area, he/she has to carry with a flashlight and uses one hand to hold the tool and the other hand to hold the flashlight. This more or less limits the user to handle the tool and could reduce the concentration of his/her mind on the object.

The present invention intends to provide an electric-powered tool having an illuminating device which can be turned on together with the driving shaft so that when using the tool, the user simply turns on the switch of the tool, the object is illuminated so that it is convenience for the user to deal with the object by the electric-powered tool. It is believed that the combination of the electric-powered tool and the illuminating device may resolve the shortcomings of the conventional electric-powered tool.

SUMMARY OF THE INVENTION

In accordance with one aspect of the present invention, there is provided an combination of an electric-powered tool and an illuminating device. The electric-powered tool comprises a handle for receiving batteries therein and a barrel portion extending laterally from the handle. A driving shaft rotatably extends from the distal end of the barrel portion and controlled by a switch connected to the barrel portion. The switch is electrically connected to the driving shaft and the batteries. The illuminating device comprises two bulbs attached beside the driving shaft and are electrically connected to the switch.

It is an object of the present invention to provide an electric-powered tool having an illuminating device which illuminates the object when turning on the electric-powered tool.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
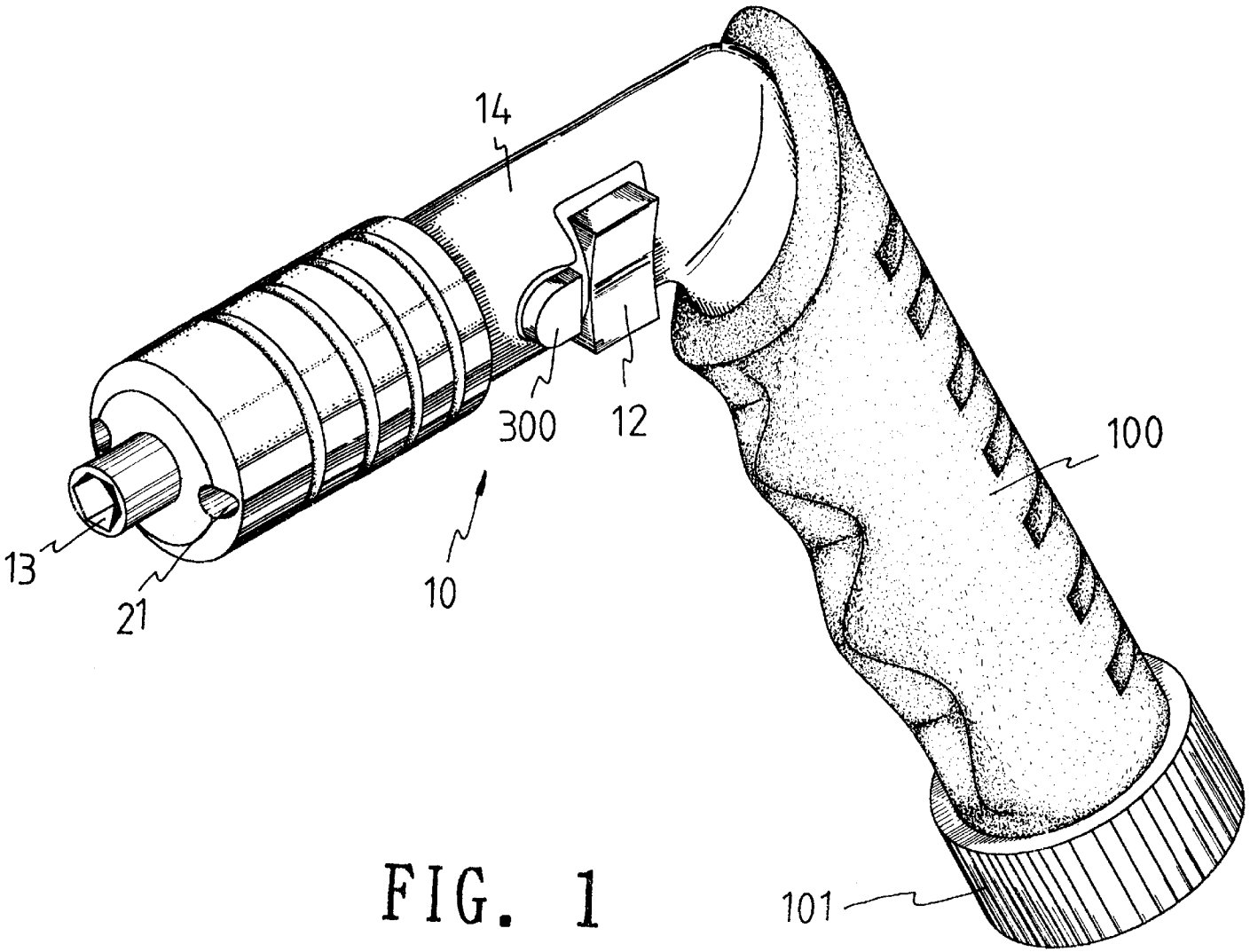
FIG. 1 is a perspective view of the electric-powered tool with the illuminating device in accordance with the present invention.
Figure 2:
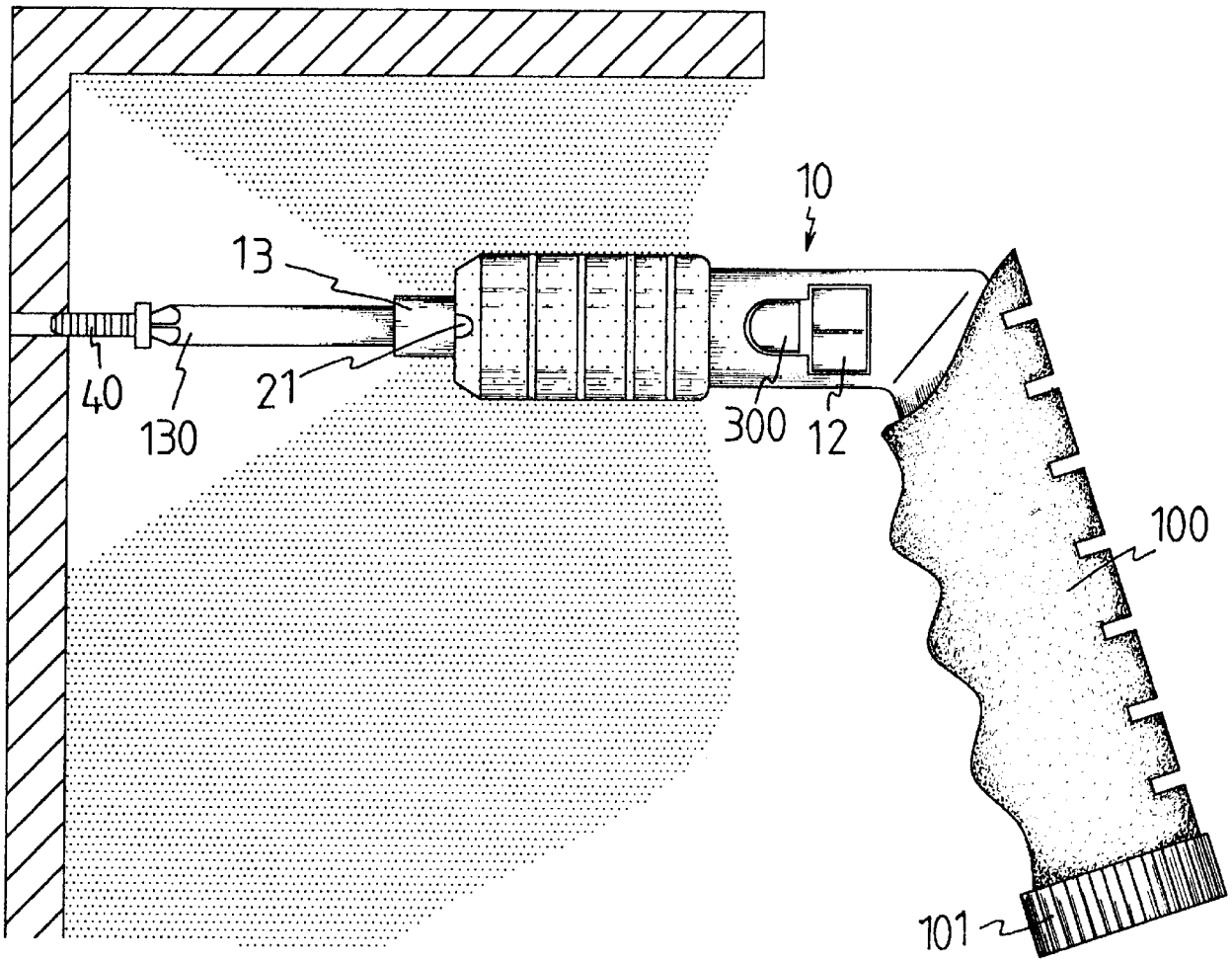
FIG. 2 is an illustrative view to show the illuminating device illuminating the object when using the tool of the present invention.
Figure 3:
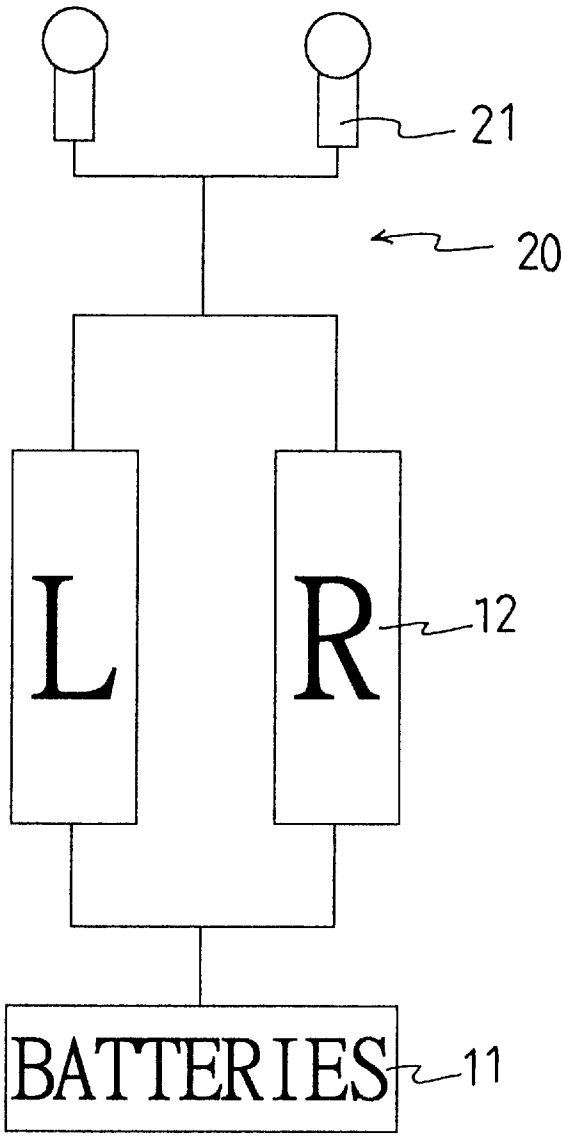
FIG. 3 is an illustrative diagram to show the arrangement of the batteries, the switch and the bulbs of the illuminating device.

Referring to FIGS. 1 to 3, the electric-powered tool (10) in accordance with the present invention comprises a handle (100) and a barrel portion (14) extending laterally from the handle (100) in which batteries (11) is received and a cap (101) is connected to the lowered of the handle (100) so as to prevent the batteries (11) from dropping from the handle (100). A driving shaft (13) rotatably extends from the distal end of the barrel portion (14) and a switch (12) is connected to the barrel portion (14). The switch (12) is electrically connected to the driving shaft (13) and the batteries (11) so that the driving shaft (13) is actuated to rotate by operating the switch (12). The switch (20) includes an L portion to let the driving shaft (13) rotate counter clockwise and an R portion to let the driving shaft (13) rotate clockwise.

The illuminating device (20) comprises two bulbs (21) attached beside the driving shaft (13) and electrically connected to the switch (12) so that when turning on the switch (12) the bulbs (21) illuminate the object such as a bolt (40) which can be rotated by a screwdriver bit (130) engaged with the driving shaft (13).

Figure 4:
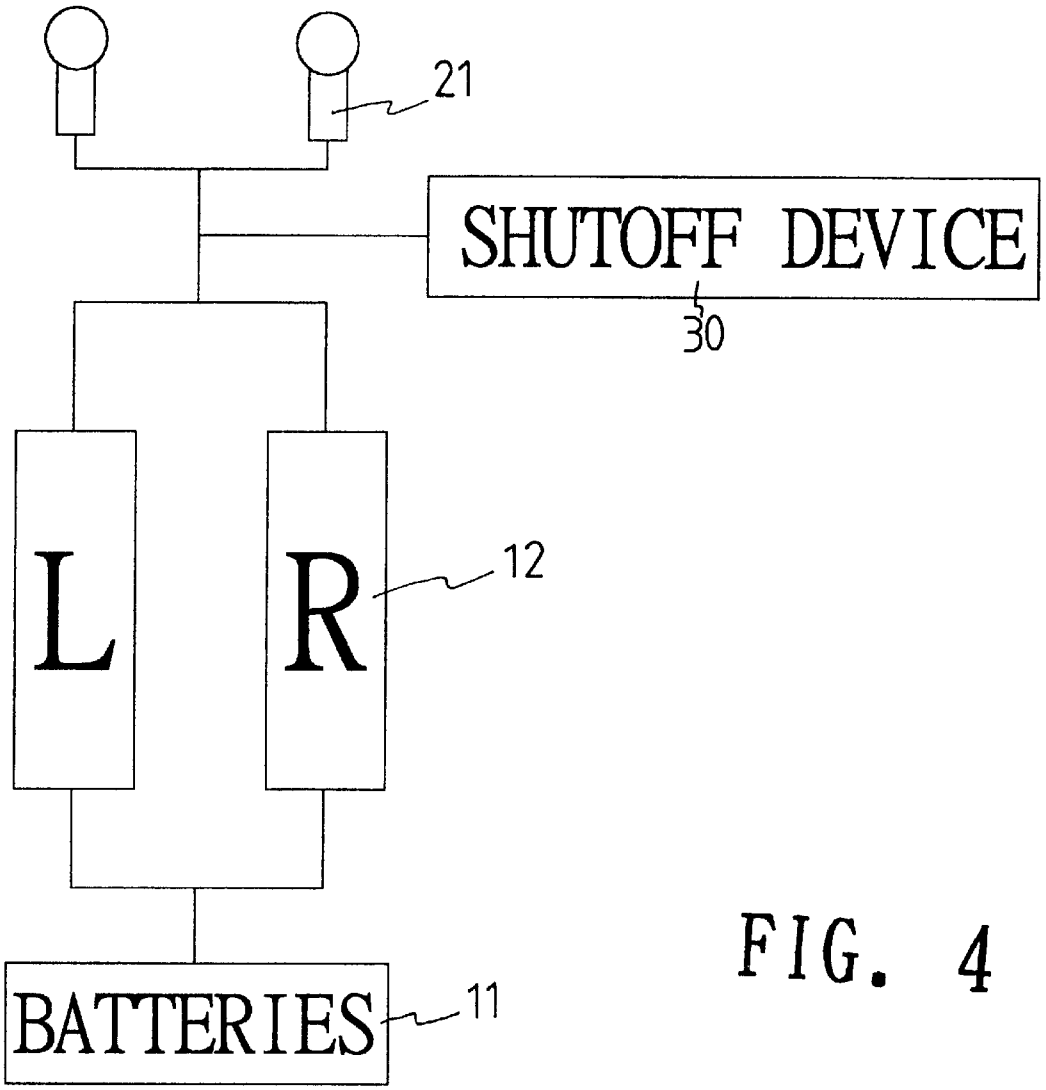
FIG. 4 is an illustrative diagram to show another embodiment of the arrangement of the batteries, the switch, the bulbs and a shutoff device of the illuminating device.

Referring to FIG. 4, a shutoff device (30) is connected between the switch (12) and the bulbs (21), and the shutoff device (30) is controlled by a button (300) attached to the barrel portion (14). Therefore, the shutoff device (30) can be turned on independently from the switch (12) so that the bulbs (21) will not be turned on while the driving shaft (13) is rotated.

The tool in accordance with the present invention provides a convenient advantage for the users to work in a dark area and only one hand can handle the tool (10) and the illuminating device (20).

While we have shown and described various embodiments in accordance with the present invention, it should be clear to those skilled in the art that further embodiments may be made without departing from the scope and spirit of the present invention.

What is claimed is:

1. A combination of an electric-powered tool (10) and an illuminating device (20), said electric-powered tool (10) comprising a handle (100) and a barrel portion (14) extending laterally from said handle (100) in which at least one battery (11) is received, a driving shaft (13) rotatably extending from the distal end of said barrel portion (14), a switch (12) connected to said barrel portion (14) and electrically connected to said driving shaft (13) and said at least one battery (11) so that said driving shaft (13) is actuated to rotate by operating said switch (12);

said illuminating device (20) comprising two bulbs (21) attached beside said driving shaft (13) and electrically connected to said switch (12), and a shutoff device (30) connected between said switch (12) and said bulbs (21) and controlled by a button (300) attached to said barrel portion (14), said button (300) located beside said switch (12).

* * * * *